US007896784B2

(12) United States Patent
Campbell

(10) Patent No.: US 7,896,784 B2
(45) Date of Patent: Mar. 1, 2011

(54) STRIDE STRETCHING APPARATUS AND METHOD

(76) Inventor: Brian E. Campbell, Oxnard, CA (US)

( * ) Notice: Subject to any disclaimer, the term of this patent is extended or adjusted under 35 U.S.C. 154(b) by 0 days.

(21) Appl. No.: 12/508,761

(22) Filed: Jul. 24, 2009

(65) Prior Publication Data

US 2009/0286661 A1 Nov. 19, 2009

Related U.S. Application Data

(63) Continuation-in-part of application No. 12/075,078, filed on Mar. 7, 2008, now abandoned.

(51) Int. Cl.
*A63B 21/002* (2006.01)

(52) U.S. Cl. ..... 482/91; 482/907

(58) Field of Classification Search ..... 482/79, 482/91, 124, 907, 122, 139; 602/23, 27–30
See application file for complete search history.

(56) References Cited

U.S. PATENT DOCUMENTS 3,713,437 A * 1/1973 Wiedmer ..... 601/27
4,728,103 A * 3/1988 Fulton ..... 482/125
4,930,767 A * 6/1990 Hamm ..... 482/80
4,998,722 A * 3/1991 Scott ..... 482/79
5,582,579 A * 12/1996 Chism et al. ..... 601/27
5,674,163 A * 10/1997 Sennett ..... 482/125
6,361,516 B1 * 3/2002 Hamel ..... 602/27
6,602,216 B1 * 8/2003 Nordt, III ..... 602/28
2004/0204301 A1 * 10/2004 Hetrick ..... 482/91

* cited by examiner

*Primary Examiner*—Loan Thanh
*Assistant Examiner*—Allana Lewin
(74) *Attorney, Agent, or Firm*—Cislo & Thomas, LLP

(57) ABSTRACT

A unique apparatus designed to facilitate various types of stretches and exercise routines found in yoga, Pilates, fitness, and rehabilitation. The stride and leg stretching system has a one-size-fits-most design, allowing comfort in operation. The stride and leg stretching system is designed to increase range of motion of the ankle joint in all three clinical planes of motion, while affecting the muscular walking system of the hips, legs, and lower back. The design allows for adjustment based on the preference of the user via a hook and loop fastener strap. The unit has a firm, non-flexible base that prevents the foot from bending, while allowing complete freedom for the ankle joint. The top portion of the foot casing is a soft, flexible material that can accommodate varying foot size comfortably. The pivoting handles allow for a comfortable grip, keeping the muscles relaxed in the upper body, and prevent unwanted torsional forces in the wrist.

1 Claim, 7 Drawing Sheets

STRIDE STRETCHING APPARATUS AND METHOD

CROSS-REFERENCES TO RELATED APPLICATIONS

This patent application claims priority to and is a continuation-in-part of U.S. patent application Ser. No. 12/075,078 filed Mar. 7, 2008 now abandoned entitled "Stride Stretcher," which application is incorporated herein by this reference.

This patent application is related to and claims priority from U.S. Provisional Patent Application Ser. No. 60/906,045 filed Mar. 8, 2007 and entitled Stride Stretcher, which application is incorporated herein by this reference.

TECHNICAL FIELD

This invention relates to device-assisted stretching, as well as associated apparatuses and methods, to access the muscle groups found in the low back, upper thigh, lower legs, and feet, for the purpose of enhancing the gait pattern of the user.

BACKGROUND ART

Some exercises, such as those as in an exercise class, may focus on biomechanical function of the lower body. During such exercises, an instructor may try to obtain certain foot motion using a strap. However, without the ability to stabilize the foot, the stretching activity/exercise may not be effective or as effective as it could be.

Often, canvas or woven straps are used in yoga exercises and the like to achieve stretching as about the hips when manual engagement of the feet is used to accomplish the stretch. Additionally, a strap may be used to control the ambulatory/gait activity of the person exercising.

The canvas material of the yoga strap would prevent ease of motion about the wrists and elbows which may create excessive tension in the upper body that conflicts with the intent to stretch in a relaxed manner. The present art enables individuals to flex and stretch the foot but without the ability to stabilize the foot, the stretch is not as effective. In the past, the canvas material of the yoga strap also prevented ease of motion about the wrist and elbows, creating excessive tension in the upper body while trying to do a relaxing stretch.

As can be understood, the use of single strap against the arch of the foot may be subject to slippage or instability. Consequently, it becomes more difficult to achieve the stretch or exercise desired as focus or concentration may be diverted from the stretch or exercise and delivered to the strap and its engagement with the foot.

With regard to existing devices, in the device disclosed by the Fulton patent (U.S. Pat. No. 4,728,103) the apparatus has four strap attachments with five different planes of motion based on the operator's ability to get straps in the correct position for the stretch they are wanting. By comparison, the current device has only two strap attachments, with only one strap position required to generate the same multi-planar effect on the ankle, knee, and hip joints. In addition, the low mobility population that would be drawn to this piece of equipment could also find the complexity of the Fulton device an inhibitor to executing the exercise correctly. Seniors and those with poor kinesthesia could potentially be lacking the fine motor skill necessary to clamp and unclamp any equipment fasteners. The present device, however, is a simplified, more user-friendly apparatus to achieve correct ankle, knee, hip, and low back mobility.

In the device disclosed by Chism et al. (U.S. Pat. No. 5,582,579), the apparatus prevents the maximal articulation of the ankle and sub-talar joint due to the fitted boot structure. The present device, by comparison, is designed to specifically articulate all joints required for optimal gait, including the ankle and sub-talar joint.

In the device disclosed by Sennet (U.S. Pat. No. 5,674,163), the apparatus articulates both hip joints into flexion, but prevents the individual articulation of the pelvis/hip articulation necessary for correct gait pattern.

Furthermore, many of the existing devices are not lightweight or portable.

Consequently, there are some shortcomings in current exercise straps and the like when used in conjunction with the user's foot and better engagement/stability is one area open for development.

DISCLOSURE OF INVENTION

In view of the foregoing disadvantages inherent in the known types of stride and leg stretching devices now present in the prior art, the present invention provides a new device by which the user's gait/stride/leg exercises may be better accommodated and achieved wherein the same can be used for such exercises to improve physical fitness of the individual, particularly at/or below the hips.

The general purpose of the present invention, which is described in greater detail below, is to provide a new system by which leg exercises are better and more controllably achieved which has many of the advantage of prior leg/gait exercising systems mentioned heretofore and many novel features that result in a new stride stretching apparatus and method which are not anticipated, rendered obvious, suggested, taught, or even implied by any of the prior art leg exercising systems, either alone or in any combination thereof.

The present invention disclosed herein better facilitates passive stretching for functional movements of the hips and legs while walking. The user of the present system has the ability to increase the range of motion of the ankle and knee, hips, and lower back. The present system can be used in the home of an individual, in a physical therapy/rehabilitation clinic, and/or in a fitness-class format.

The present system provides a unique foot support for holding the foot in an extended fashion with straps to facilitate manipulation of movement of the foot. This design maximizes the range of motion of the ankle in all three planes (sagittal, frontal, and transverse), while also allowing the user to keep the shoulders relaxed and the forearms from gripping excessively.

In one embodiment, a foot securing system is used to engage the foot while an elongated strap is attached with one end on either side of the individual's foot. In another embodiment, the strap is attached towards the front part of the foot-securing device. Other geometries and configurations may be used. The foot-securing device may be in the form of a sandal or the like, for easy engagement with the foot and removable pivoting handles may attach to the elongated strap using a metal hook. By use of removable pivoting handles, the user can better engage the elongated strap in order to control the action on the foot. Additionally, the user's hand may engage a more comfortable device by which the user can engage and manipulate the present system as well as articulating the foot and/or leg.

By enabling greater articulation and control over the articulation and movement of the lower leg by means located at the user's foot, the present invention enables better stretching and exercise in a manner that is consistent with yoga practices and other exercise systems.

Other embodiments of the present invention are set forth in more detail, below, and the embodiments set forth above are made for purposes of example only and not of limitation.

BEST MODE FOR CARRYING OUT THE INVENTION

Figure 1:
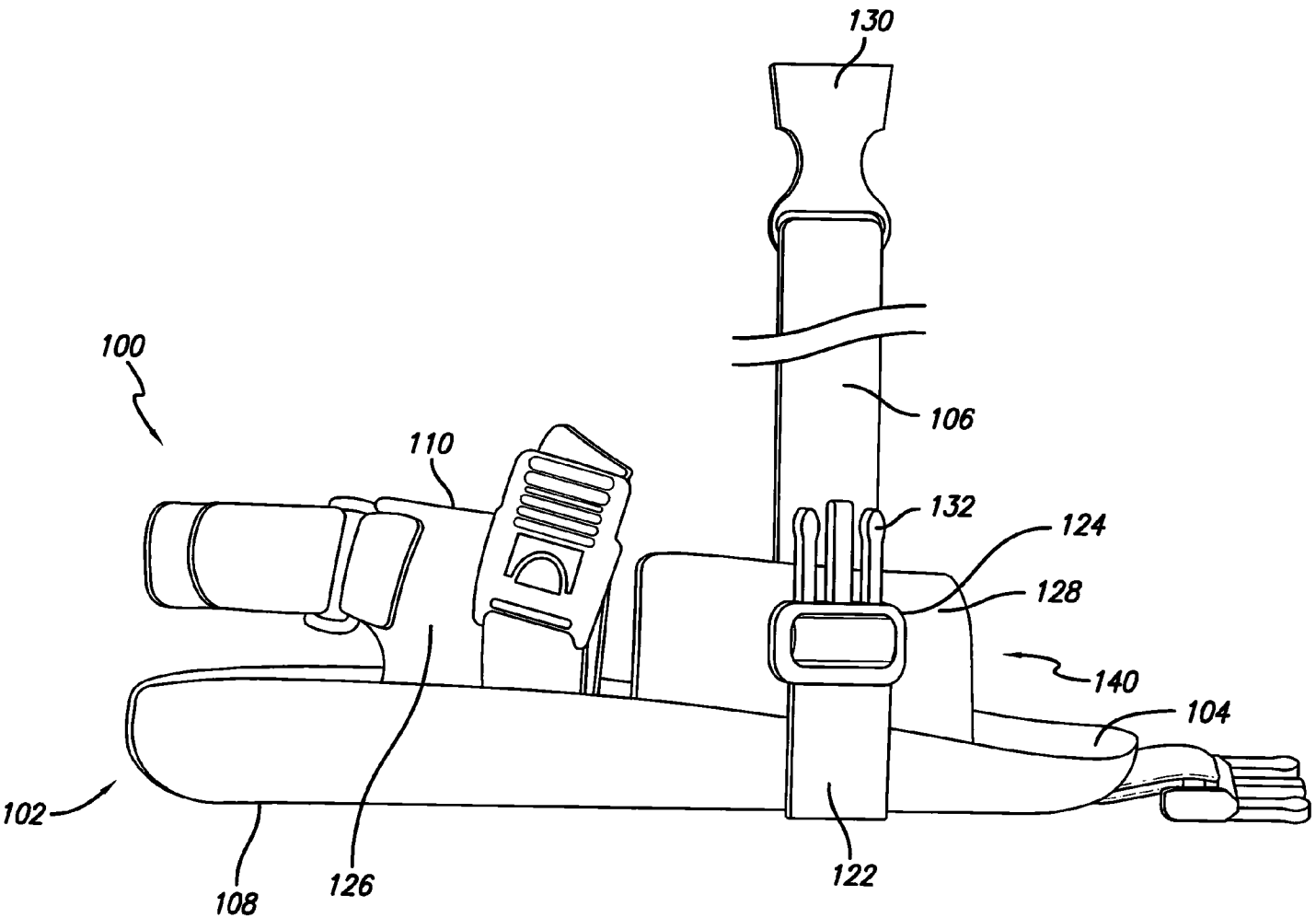
FIG. 1 is a right side elevational view of the present invention.
Figure 2:
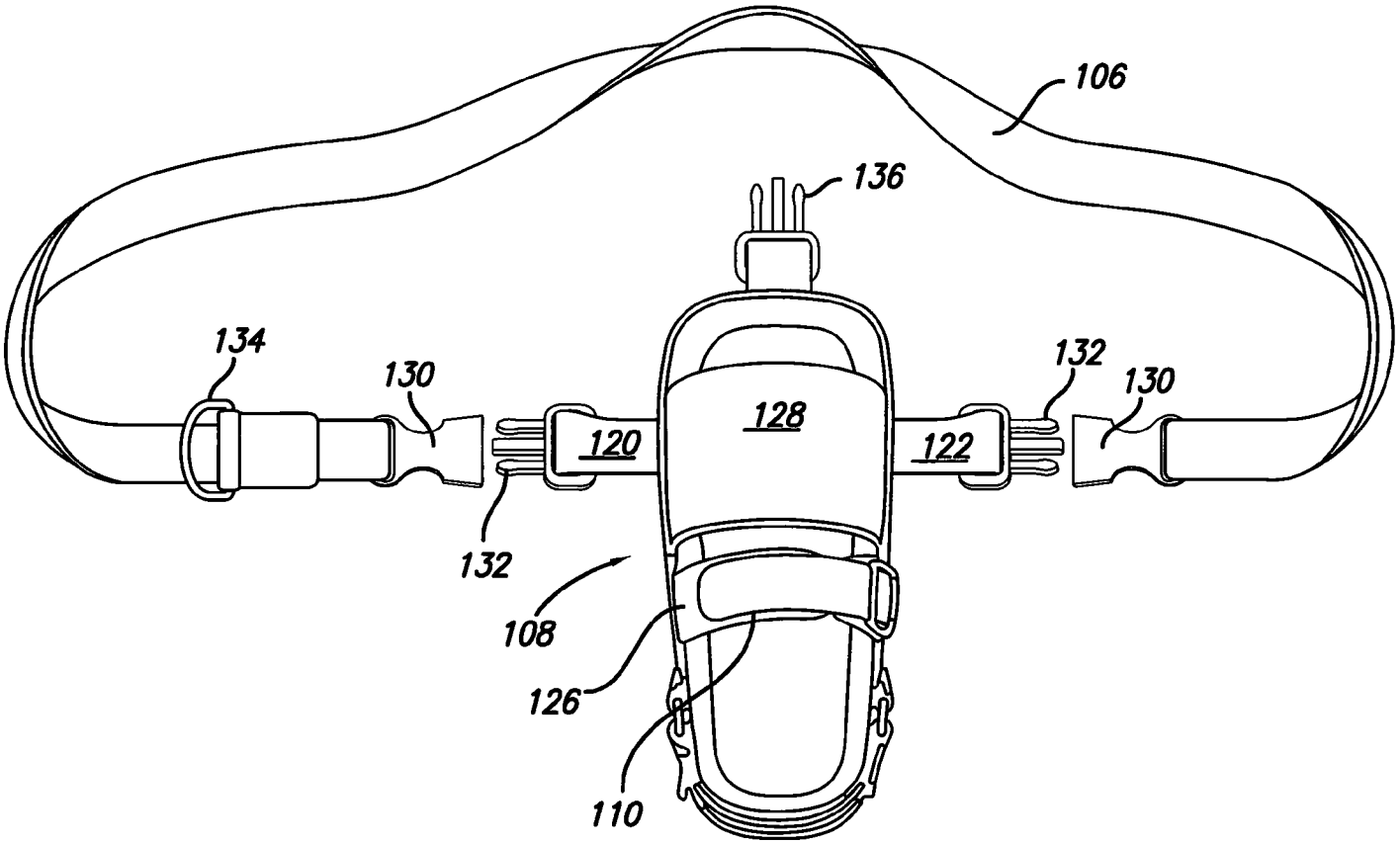
FIG. 2 is a top plan view of the present invention.
Figure 3:
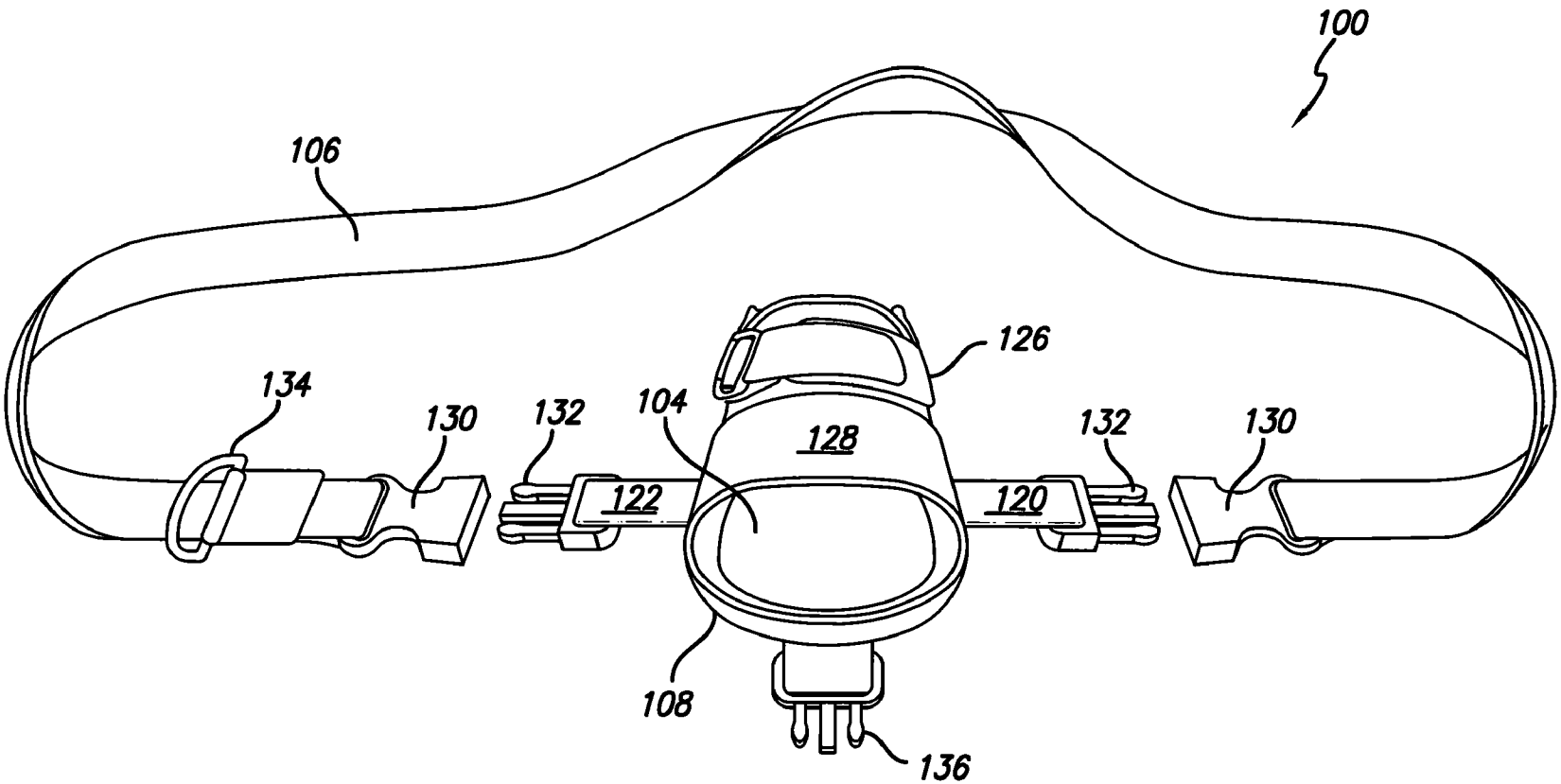
FIG. 3 is a front perspective view of the present invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The masculine pronoun is generally used herein to indicate the generic individual and as a matter of convention and convenience.

The present invention resides in a foot and leg stretching systems that enables better stretching of the ankle, leg, and hip as well as enabling gait pattern enhancement. The foot is secured in a sandal-like restraint system while a removably attachable strap enables stretching and gait-enhancement. A variety of configurations and positions enable the strap to better manipulate the foot, ankle, leg and hip.

Referring to the drawings, where like numerals of reference designate like elements throughout, it will be noted that the stride and leg stretching system provides a unique apparatus that is intended to stretch the area from the user's foot to the user's pelvis as a unit. Unlike other stretching gadgets and straps, the stride and leg stretching system set forth herein includes a shoe like member as well as hand controls that allow the user to change the angle of the sub-talar (ankle) joint and not just the sagittal plane, but also in the frontal plane to obtain inversion and/or eversion.

The "shoe" 102 of the present systems generally prevents the longitudinal arch of the foot from shortening during stretching, thereby increasing the stretch of the plantar fascia of the foot, this being a component of stretching that is often missing from other stretching tools and devices currently and/or previously known. The stride and leg stretching system 100 also maintains the position of the foot relative to the leg during adduction of the femur, which, in turn, increases the stretch of the hip.

One significant feature of the stride and leg stretching system set forth herein is its adjustability and its ability to stretch the entire walking unit of the skeleton from the pelvis to the toes. In the past, although many different stretching routines are required for exercise classes, including those required to become a certified fitness trainer, generally, no single piece of equipment, band, or strap was available to create the type of total stretch available through the stride and leg stretching system of the present invention.

The stride and leg stretching system 100 is designed with a hard insole 104 which creates support when articulating the strap 106 in various movements. The hard insole 104 provides the stride and leg stretching system 100 with its ability to be able to be used in a standing position with the user's full weight bearing on it as well when the user is in a sitting position or when the user is lying down. The sole 108 of the shoe 102 has a hook and loop fastener bottom 110 which provides the left and right strap harnesses 120, 122 the ability to be easily adjusted to accommodate feet of various sizes and to allow for proper foot alignment. Both the upper and lower sections 126, 128 of the shoe harness 140 are designed to saddle the foot.

The stride and leg stretching system has a main strap 106 that has two female ends 130 on it that connect to male ends 132 of the strap harness 124. Alternatively, one female end 130 may attach to the front male end 136 to provide an additional useful configuration. The stride and leg stretching main strap 106 can be removed from the sole 108 and may have a D-ring 134 at one side of the strap 106 to allow the other female end 130 of the strap to loop through the D-ring 134 and be used as another stretching configuration.

Generally, the stride and leg stretching system may have four distinct components, including the main strap 106, a strap harness 124, a shoe harness 140 and a shoe sole 108.

In one embodiment, the sole 108 of the stride and leg stretching system 100 may be molded plastic material approximately 3/16 inches thick with a length of approximately 10 inches. The front width may be approximately 4 and 5/8 (4.625) inches with the rear heel insert being approximately 3 inches. Raised sides may be present on the sole 108 and may be approximately 1 inch in height tapering to 2 inches at the heel insert.

Figure 4:
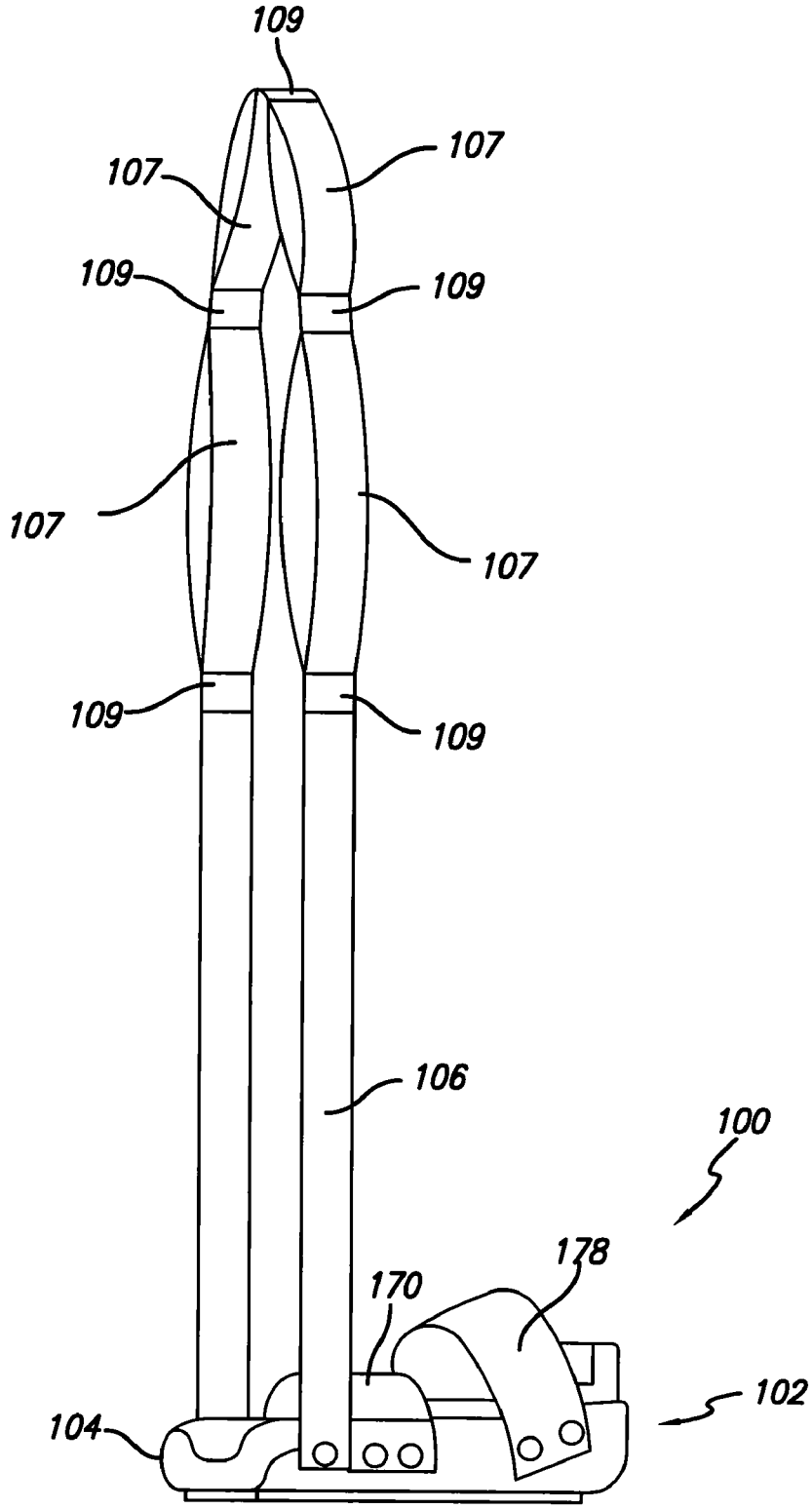
FIG. 4 is a perspective view of the present invention showing the sole of the unit, front securing strap, front securing hand strap, sole traction pads, sole insert, unit hand strap, and the rear ankle strap.

The hand strap 106 may be soft, pliable woven material approximately 6 feet in length and approximately 1 and 1/2 (1.5) inches in width. The hand strap 106 may be approximately 1/16 inch thick. A first opening or hand insert 107 may be present in the hand strap 106 approximately 18 inches from the point of attachment with the sole 108. A corresponding hand insert 107 may be present on the other side of the strap 106. The hand insert 107 is preferably a series of loops, each being approximately 5 inches long, with about 2 inches between each loop. The loops could be formed by affixing an additional ply of the hand strap 106 to the remainder of the hand strap 106 at the regions marked 109 in FIG. 4. FIG. 4 shows a series of four such loops for the use of hands to articulate the device 100.

Figure 5:
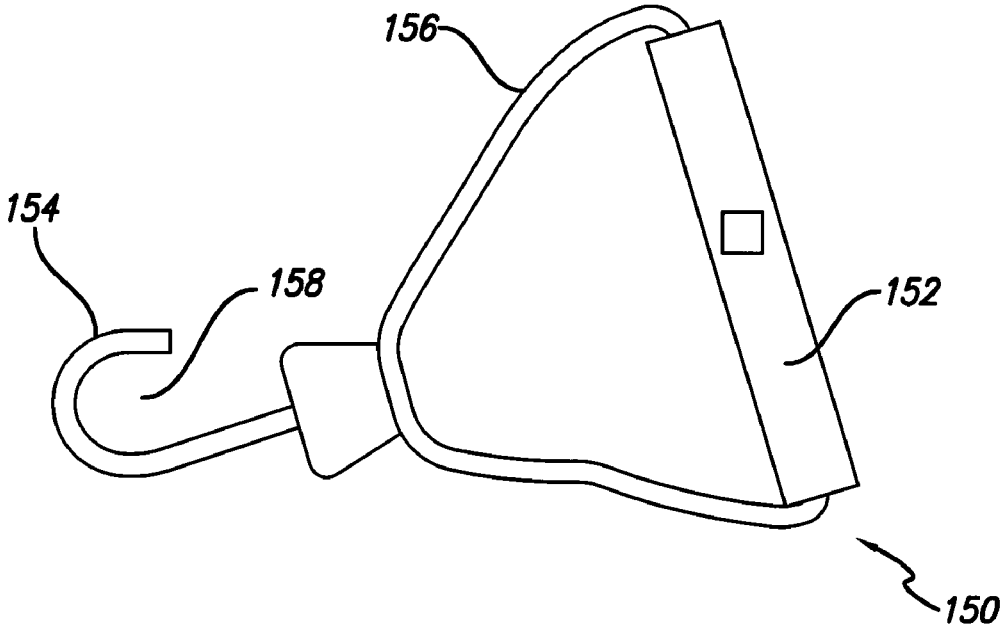
FIG. 5 is a side view of the removable pivoting handles.

As shown in FIG. 5, there may be two interchangeable handles 150 used in tandem with the stride and leg stretching system. The handles 150 may have a hollow plastic sleeve approximately 5 inches in width and 3/4 inch in diameter. A hook 154 with the hollow plastic sleeve 152 being on the handles 150 may attach to the hand openings of the hand strap 106. A handle strap 156 connects the sleeve 152 and the hook 154. The handle strap 156 may be approximately 1 inch thick and 15 inches in length. The pivoting handles 150 removably attach to the main hand strap 106 using the metal hook 154 which is approximately 3 inches long and approximately 3/16 inch in diameter. The mouth 158 of the hook 154 may have a 1-inch opening that enables it to feed into the hand openings of the main hand strap 106.

As shown in an alternative embodiment portrayed in FIGS. 4 and 6-8, a front securing strap 170 of the shoe harness 140 may be used to secure the foot in the sole 108 and/or hard insoles 104 and may be approximately 2 inches wide and 12 inches in length.

The front securing hold-downs 172 are situated on either side of the front part of the sole 108. The front securing hold-downs 172 may be plastic reticular rings with radius edges that may allow the front securing strap 170 to feed through and return over the foot to secure the foot in the unit 100. The front securing hold-downs may be approximately 2 and 3/8 inches wide by approximately 3/4 inches tall.

A rear ankle strap 178 of the shoe harness 140 serves to secure the ankle onto the hard insole 104. The rear ankle strap 178 may be approximately 2 inches wide by approximately 3 inches long by approximately 3/8 inches thick. The rear ankle strap 178 may be constructed of pliable materials so that the ankle may be strapped into place within the unit.

Figure 6:
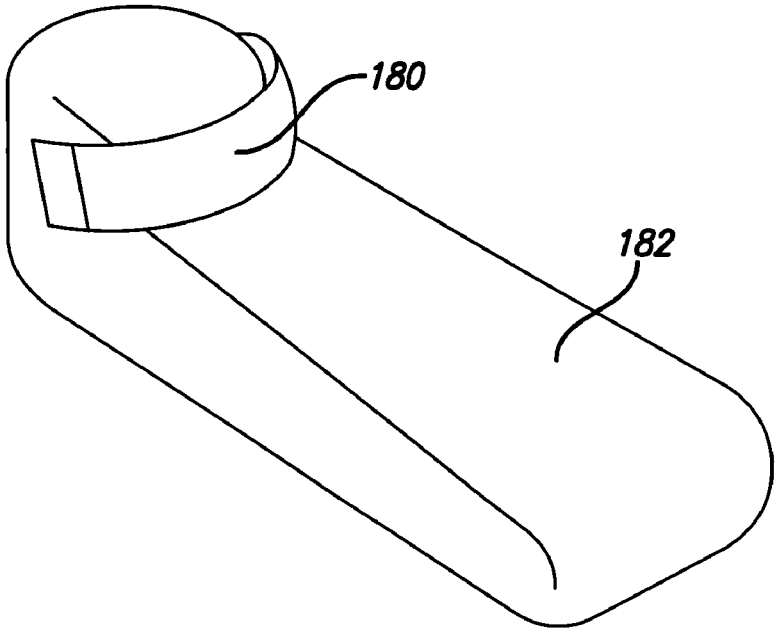
FIG. 6 is a topside view of the small ankle strap and sole insert.
Figure 7:
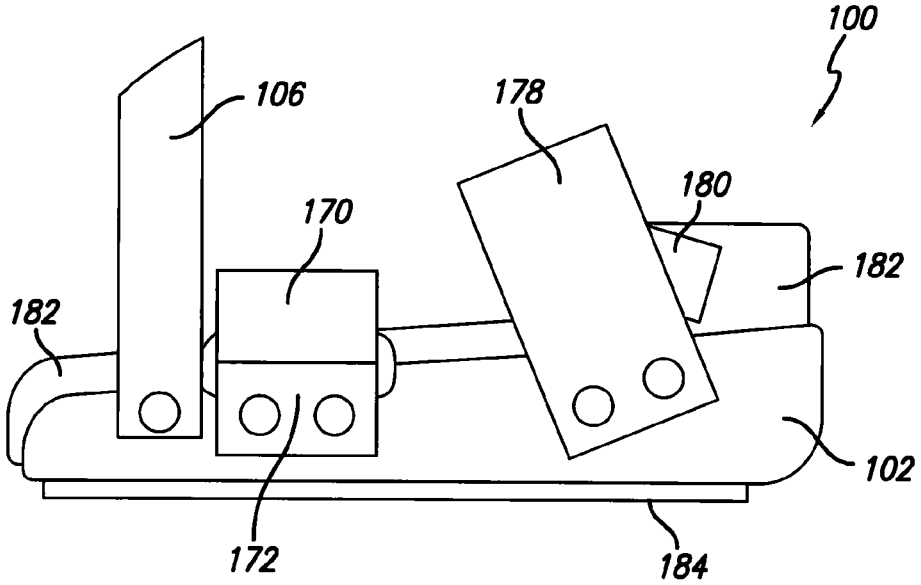
FIG. 7 is a side view of the stride and leg stretching system without the straps attached.

A small ankle strap 180 is shown in FIG. 6 and may be attached to an upward rear collar portion of the sole insert 182 of the system 100. The small ankle strap 180 may be approximately 6 inches long and approximately 1 inch wide and may be constructed of soft pliable material that serves to seat the heel into the unit.

Figure 8:
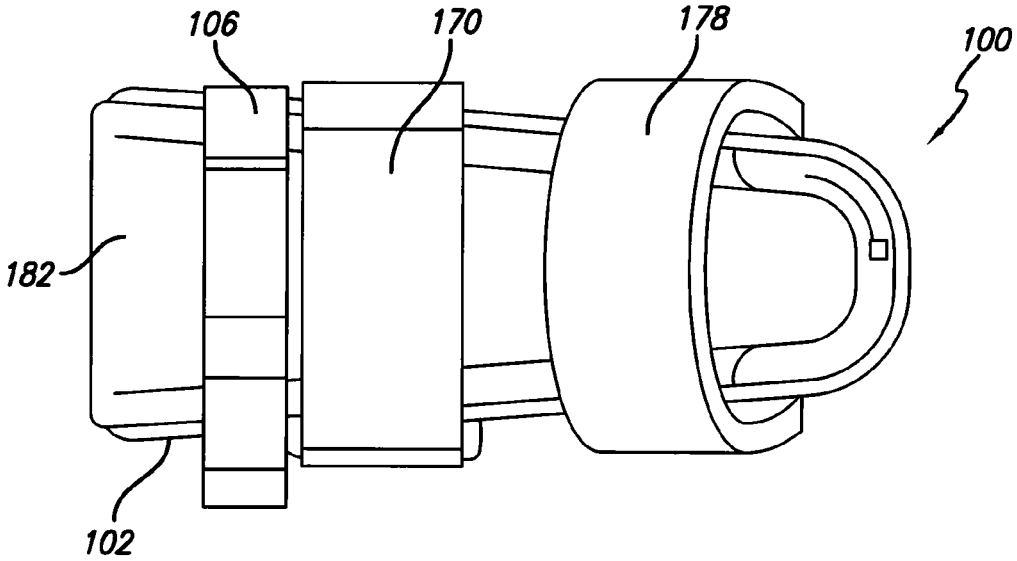
FIG. 8 is a top side view of the stride and leg stretching system without the straps attached.
Figure 9:
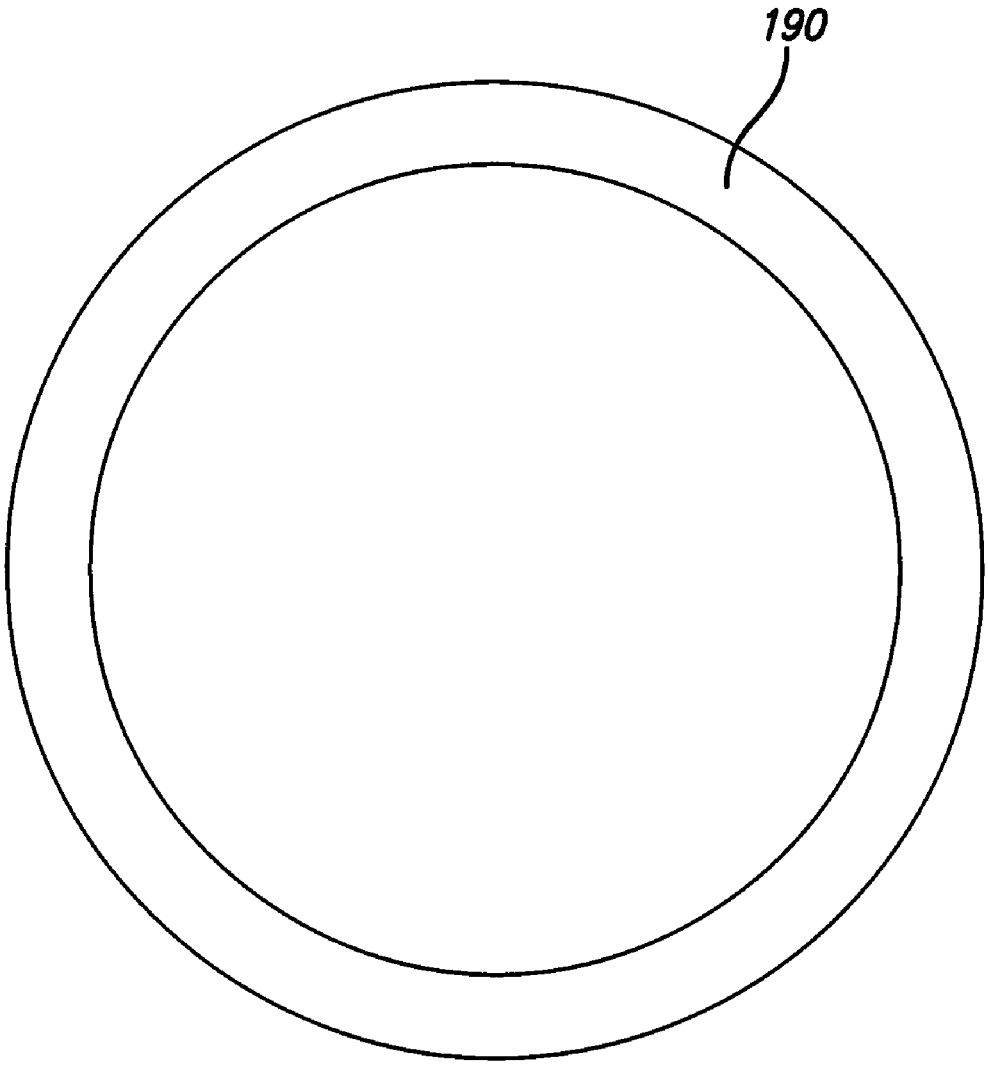
FIG. 9 is a view of the unit strap ring.

A sole insert 182 as shown in FIGS. 6 and 8 may be present at the heel portion of the unit 100. The sole insert 182 may be constructed of memory foam material and may line the inside of the hard plastic molded unit 104. The sole insert may be approximately 10 inches in length and 1/2 inch thick material as shown in FIG. 6. In FIG. 6, the small ankle strap 180 serves to hold the user's ankle in place on the hard insole 104. The sole insert 182 may serve to cushion the user's foot.

A sole traction pad 184 may cover the bottom of the sole 108. The sole traction pad 184 lines the bottom of the sole 108 and may be approximately 8 and 3/4 inches in length and approximately 3 and 1/4 inches wide at the front while being approximately 2 and 1/2 inches wide at the rear radius corners for the conforming heel of the sole 108.

A unit strap ring of metal may generally be used to feed the strap 106 through for storage purposes. The unit strap ring 190 may measure approximately 1 and 3/8 inch in diameter and approximately 1/8 inch in thickness. The unit strap ring 190 may be located as desired along the unit, but possible along an exterior portion thereof for the outside of each foot.

These and other solutions provided by the present invention will be apparent from a review of the specification herein and accompanying drawings. The foregoing are some of but a few of the goals sought to be attained by the present invention and are set forth for the purposes of example only and not those of limitation.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use apparatuses for device-assisted stretching to access the muscle groups found in the low back, upper thigh, lower legs, and feet, for the purpose of enhancing the gait pattern of the user.

What is claimed is:

1. A stride and leg stretching system for enabling stretching of a user's musculoskeletal system generally at or below the user's hips, the stride and leg stretching system comprising:

a foot-engaging portion for securely engaging a foot, the foot-engaging portion having a front side, a rear side, a left side, and a right side, the foot-engaging portion being detachably attachable to a user's foot, the foot-engaging portion having a sole adapted to prevent the foot from bending while providing freedom of articulation for a user's ankle joint, the sole having a lower side for engaging the ground and an upper side for engaging the foot, the sole of resilient material sufficient to support a person's weight and to provide pedal support for the person's foot;

the lower side of the sole having at least one side of a hook and loop fastener pair exposed thereon, the sole adapted to provide easier adjustment for various size feet via the hook and loop fastener pair;

the sole being approximately three-sixteenth inch thick, being approximately ten inches long, having a front width of approximately four and five-eighths inch, and having a rear heel insert area approximately three inches wide;

the sole having the left side and the right side raised approximately one inch in height tapering to approximately two inches in height at approximately the heel insert area;

the foot-engaging portion further having a harness coupled to the sole and adapted to detachably engage the foot to hold the sole on the foot, the harness further having a rear ankle strap and a front securing strap with the rear ankle strap adapted to secure a user's ankle upon a heel portion of the sole and the front securing strap adapted to secure a front part of the user's foot upon a front of the sole;

the rear ankle strap approximately two inches wide, approximately thirteen inches long and approximately three-eighths inches thick and constructed of soft, pliable material;

the front securing strap approximately two inches wide and approximately twelve inches in length;

a manual-engagement strap for manual engagement by the user wearing the foot-engaging portion, the manual engagement strap attached on a first side to the left side of the foot-engaging portion and attached on a second side to the right side of the foot-engaging portion;

the manual-engagement strap including soft, pliable woven material, the manual engagement strap being approximately six feet in length, being approximately one and one-half inches in width, and being approximately one-sixteenth inch in thickness;

the manual engagement strap including a hand insert;

the hand insert having a first opening approximately eighteen inches from a point of attachment of the manual engagement strap with the foot-engaging portion, the hand insert comprising a series of loops adapted for engagement by a user's hand, each loop being approximately five inches long, with about 2 inches between each loop, whereby the user may use the user's hand to articulate the manual engagement strap and the foot-engaging portion;

a removable handle adapted for engaging an opening in the manual engagement strap, the removable handle enabling better manual engagement of the manual-engagement strap and resulting flexible articulation of the person's foot;

the removable handle further having a hook portion for removably engaging the manual-engagement strap and a handle portion coupled to the hook portion, the handle portion adapted for manual engagement and controlling tension on the hook portion;

whereby the use may attach the foot-engaging portion to the foot and subsequently stretch the user's stride and/or leg associated with the foot by manipulating and engaging the manual-engagement strap either manually or with the removable handle.

* * * * *